US007327098B2

(12) United States Patent
Chen

(10) Patent No.: US 7,327,098 B2
(45) Date of Patent: Feb. 5, 2008

(54) LED CONTROLLER AND CONTROL METHOD THEREOF

(75) Inventor: Cheng Fang Chen, Taipei (TW)

(73) Assignee: Premier Image Technology Corp. (TW)

( * ) Notice: Subject to any disclaimer, the term of this patent is extended or adjusted under 35 U.S.C. 154(b) by 132 days.

(21) Appl. No.: 11/134,128

(22) Filed: May 20, 2005

(65) Prior Publication Data

US 2006/0091826 A1 May 4, 2006

(30) Foreign Application Priority Data

Oct. 28, 2004 (TW) ..... 93132650 A

(51) Int. Cl.
*H05B 37/00* (2006.01)

(52) U.S. Cl. ..... 315/291; 315/312; 315/313

(58) Field of Classification Search ..... 315/312, 315/313, 291; 362/800
See application file for complete search history.

(56) References Cited

U.S. PATENT DOCUMENTS 6,498,440 B2 * 12/2002 Stam et al. ..... 315/291
2006/0006821 A1 * 1/2006 Singer et al. ..... 315/312

* cited by examiner

*Primary Examiner*—David H. Vu

(57) ABSTRACT

A LED controller and a control method thereof are disclosed. The LED controller can generate a control signal to drive a LED, measure a luminous intensity value of the LED, and selectively adjust the control signal according to the measured value to dynamically adjust the luminous intensity. Besides, a simple design of driving circuit is applied to achieve an effect of dynamically adjusting the current of the LED.

19 Claims, 5 Drawing Sheets

LED CONTROLLER AND CONTROL METHOD THEREOF

BACKGROUND OF INVENTION

1. Field of the Invention

The present invention relates in general to light-emitting diodes (LED), and more particularly to a LED controller and a control method thereof.

2. Description of the Prior Art

In recent years, the LED technology develops rapidly and the performance of LED gets better with a lower manufacturing cost. Thus, the application range of LED is also extended wider gradually. However, the LED may be aging and its luminous intensity is lowered after operating for a long time. Further, in some applications such as the projector using the LED as a light source, the aging LED would cause bad color saturation.

Besides, in the application of color-mixing with various colors of LED, e.g. using red, green and blue LEDs to mix a white light, it is possible to cause an unbalanced result and deviate from the expected white color, due to the aging LED or other variation factors. At this time, if we can determine the degree of deviation according to the actual color-mixing result and change the mix ratio for each color of LED, then a more ideal color-mixing result would be achieved.

SUMMARY OF INVENTION

In view of this, an object of the present invention is to provide a LED controller and a control method thereof, which can dynamically adjust the current of a LED according to the luminous intensity of the LED, thereby changing the subsequent luminous intensity of the LED.

Another object of the present invention is to provide a LED controller and a control method thereof, which can adjust the mix ratio of various colors of LED by dynamically adjusting the current flowing through each color of LED, thereby achieving a desired color-mixing effect.

Another object of the present invention is to provide a LED driving device which can achieve the effect of dynamically adjusting the LED current by a simple circuit design.

Accordingly, in attainment of the aforementioned objects, the LED controller of the present invention comprises a sensing unit, a control unit, and a driving unit. The sensing unit can sense a luminous intensity of a LED and output a corresponding sensing signal to the control unit. According to the sensing signal, the control unit can output a control signal to the driving unit. The driving unit can drive the LED according to the control signal.

In another aspect, the LED control method of the present invention comprises: generating a control signal to drive a LED; sensing a luminous intensity value of the LED; and selectively adjusting the control signal according to the luminous intensity value.

In another aspect, the LED driving device of the present invention comprises: a LED unit for emitting a luminous intensity according to a corresponding driving signal, and a first adjusting unit for generating an adjusting signal to the LED unit according to a pulse width modulation (PWM) signal and adjusting the luminous intensity according to the adjusting signal.

DETAILED DESCRIPTION

Figure 1:
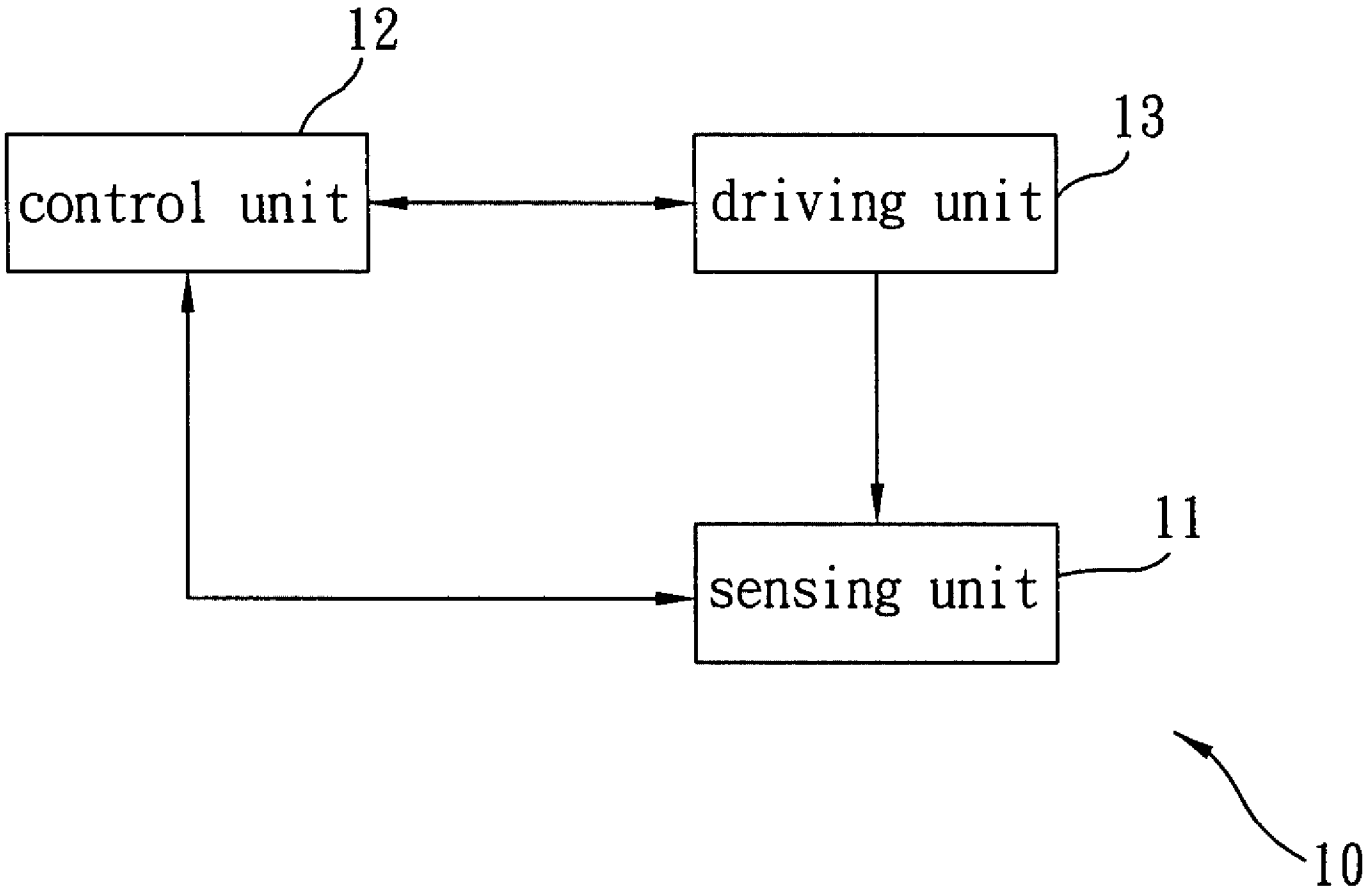
FIG. 1 is a block diagram of a preferred embodiment of the LED controller according to the present invention.

FIG. 1 is a block diagram of a preferred embodiment of the LED controller according to the present invention. As shown in FIG. 1, the LED controller 10 comprises a sensing unit 11, a control unit 12, and a driving unit 13. The sensing unit 11 can detect the luminous intensity of a LED (within the driving unit 13 and not shown in FIG. 1), and output a corresponding sensing signal. In one embodiment, the sensing unit 11 employs a photodiode (not shown) to detect the luminous intensity.

The control unit 12, coupled to the sensing unit 11, can determine if the luminous intensity of the LED reaches a predetermined value according to the sensing signal. Then, the control unit 12 outputs a control signal to the driving unit 13. When the intensity reaches the predetermined value, the control unit 12 remains to output the original control signal such that the driving unit 13 can keep the luminous intensity at the predetermined value. However, when the intensity deviates from the predetermined value, the control unit 12 would adjust the control signal such that the driving unit 13 can change the luminous intensity (described later). In one embodiment, the color of the LED is one of red, green and blue, and the LED is used to mix white light. In the colorimetry suggested by the Commission International de L'Eclairage (CIE), white can be represented as a linear combination of red, green and blue. Thus, the predetermined value can be generated according to the CIE colorimetry. For example, if the color of the LED is blue, the proportion of blue in the above linear combination can be used as the predetermined value.

After adjusting the luminous intensity to the predetermined value, the control unit 12 can further determine if the LED is aging by comparing the control signal and the subsequent sensing signal. That is, the control unit 12 can record the values of the control signal and the corresponding ideal values of the sensing signal in a table. When the "actual" value of the sensing signal is lower than the ideal value over a default degree, it means that the LED intensity does not reach the expected value, and then the LED can be judged as aging. If the LED is aging, its intensity is subject to deviate from the predetermined value. Thus, the control unit 12 would require the sensing unit 11 to perform detection again after a shorter time. On the other hand, if the LED is not aging, its intensity is not subject to deviate from the predetermined value. Thus, the control unit 12 would require the sensing unit 11 to perform detection again after a longer time.

Figure 2:
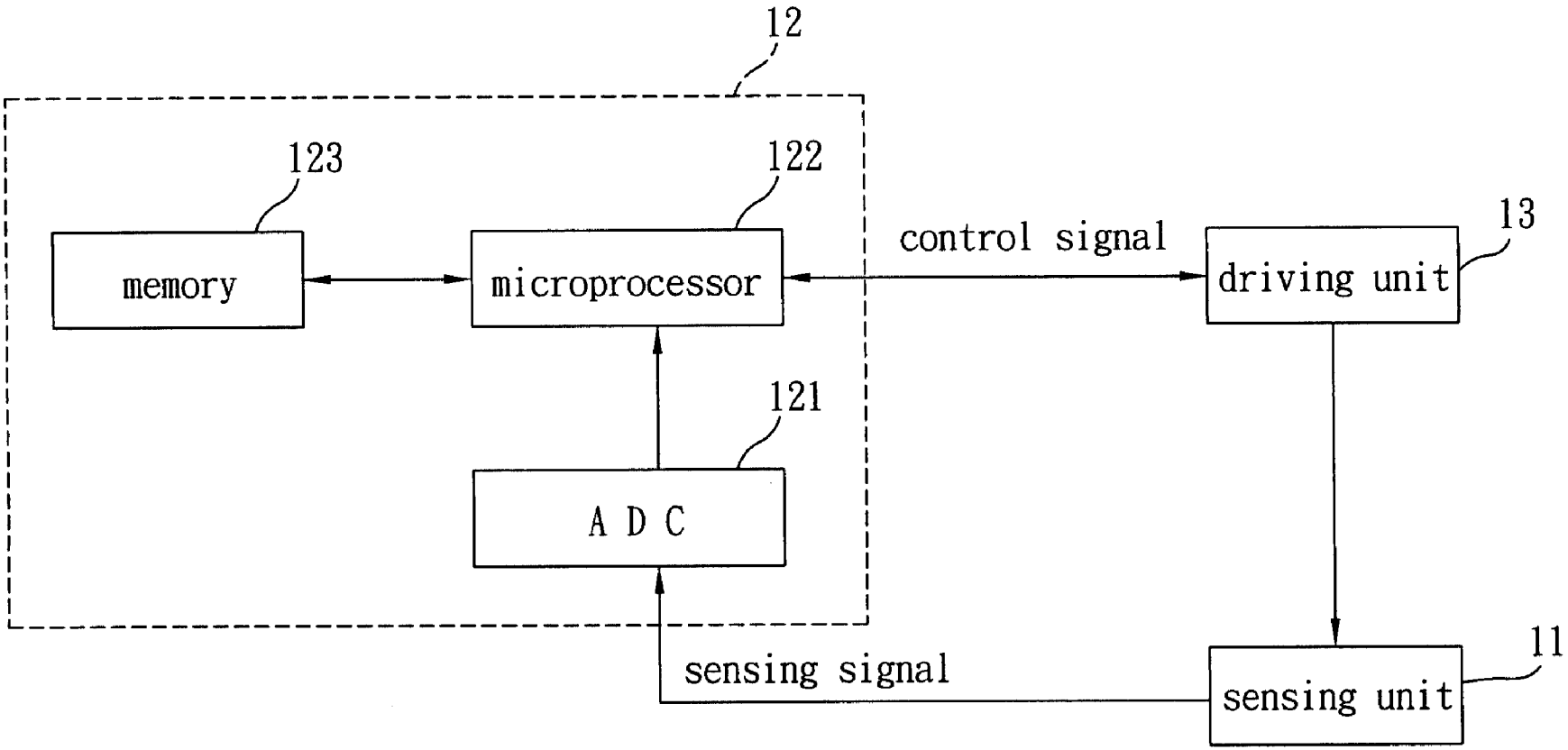
FIG. 2 is a block diagram showing a preferred embodiment of the control unit of FIG. 1.

FIG. 2 is a block diagram showing a preferred embodiment of the control unit 12 of FIG. 1. In FIG. 2, the control unit 12 comprises an analog-to-digital converter (ADC) 121, a microprocessor 122 and a memory 123. The ADC 121 can convert the above analog sensing signal into a digital response value of the luminous intensity. The memory 123 can record the correspondence between the value of the control signal and the ideal response value, and the correspondence can be used to judge if the LED is aging. The microprocessor 122, coupled to the ADC 121 and the memory 123, can execute related operations to determine whether the LED intensity reaches the predetermined value according to the actual response value provided by the ADC 122. Besides, the microprocessor 122 accesses the memory 123 and calculates the difference between the actual and ideal response values, thereby judging if the LED is aging.

Figure 3:
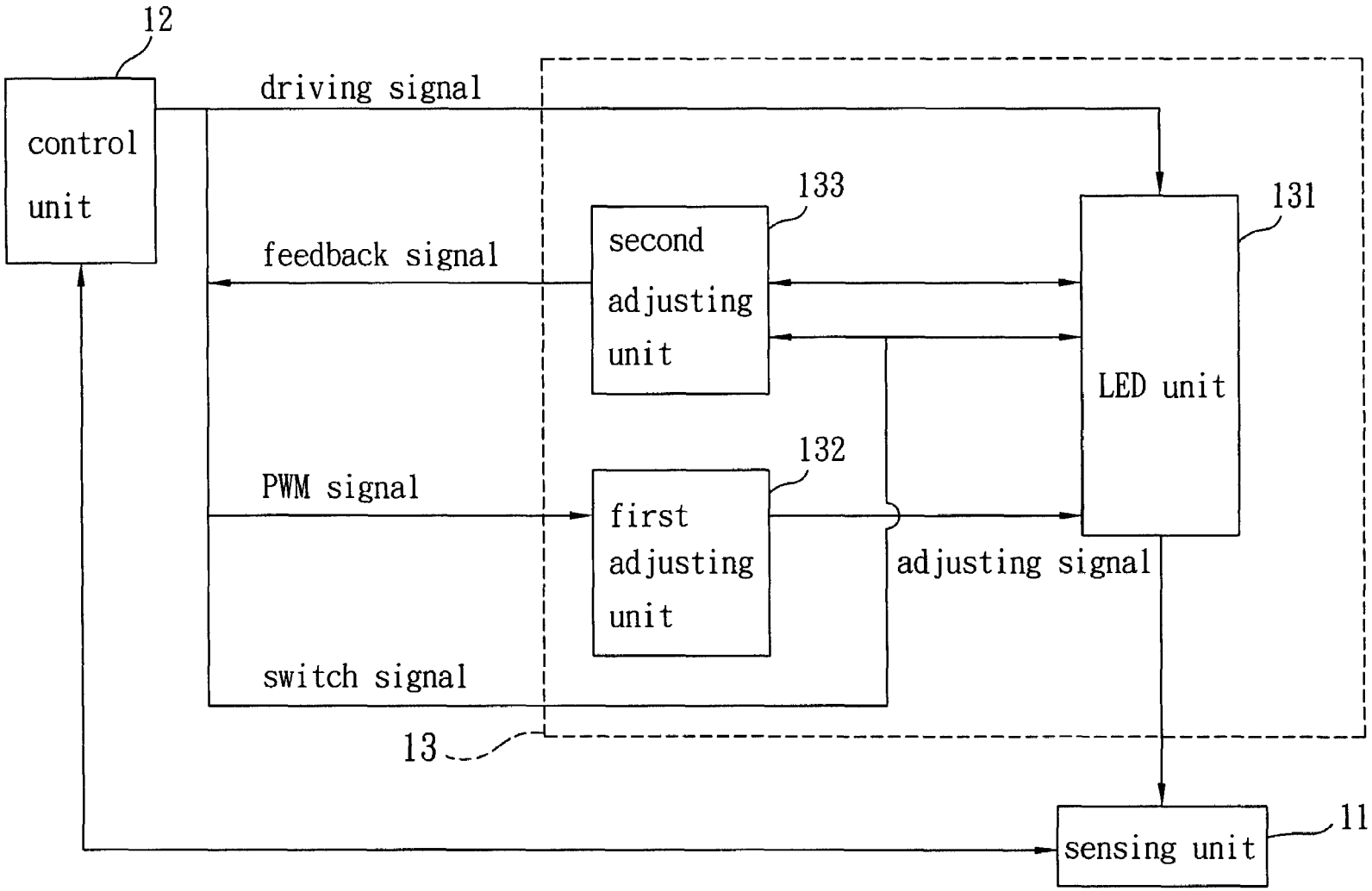
FIG. 3 is a block diagram showing a preferred embodiment of the driving unit of FIG. 1.

The driving unit 13 is coupled to the control unit 12, and drives the LED according to the control signal provided by the control unit 12. FIG. 3 is a block diagram showing a preferred embodiment of the driving unit 13 of FIG. 1. In FIG. 3, the driving unit 13 comprises a LED unit 131, a first adjusting unit 132 and a second adjusting unit 133. In this embodiment, the control signal includes a driving signal, a PWM signal and a switch signal. The LED unit1 131 includes the LED and associated control circuit, and switches between a "light-on" state and a "light-off" state according to the switch signal. Also, the LED unit 131 can receive the driving signal and drive the LED to emit a corresponding luminous intensity.

The first adjusting unit 132 receives the PWM signal and generates a corresponding adjusting signal to the LED unit 131, thereby adjusting the luminous intensity of the LED. By changing the pulse width of the PWM signal, various adjusting signals can be generated to adjust the intensity by different degrees. The second adjusting unit 133 generates a feedback signal to the control unit 12, and then the control unit 12 generates the corresponding driving signal according to the feedback signal. Thus, by adjusting the feedback signal, the driving signal can be changed, and the LED intensity can further be adjusted. Besides, the second adjusting unit 133 can accelerate discharge for the LED when the LED unit 131 switches from the light-on state to the light-off state, thereby enabling a more rapid and precise switch.

Figure 4:
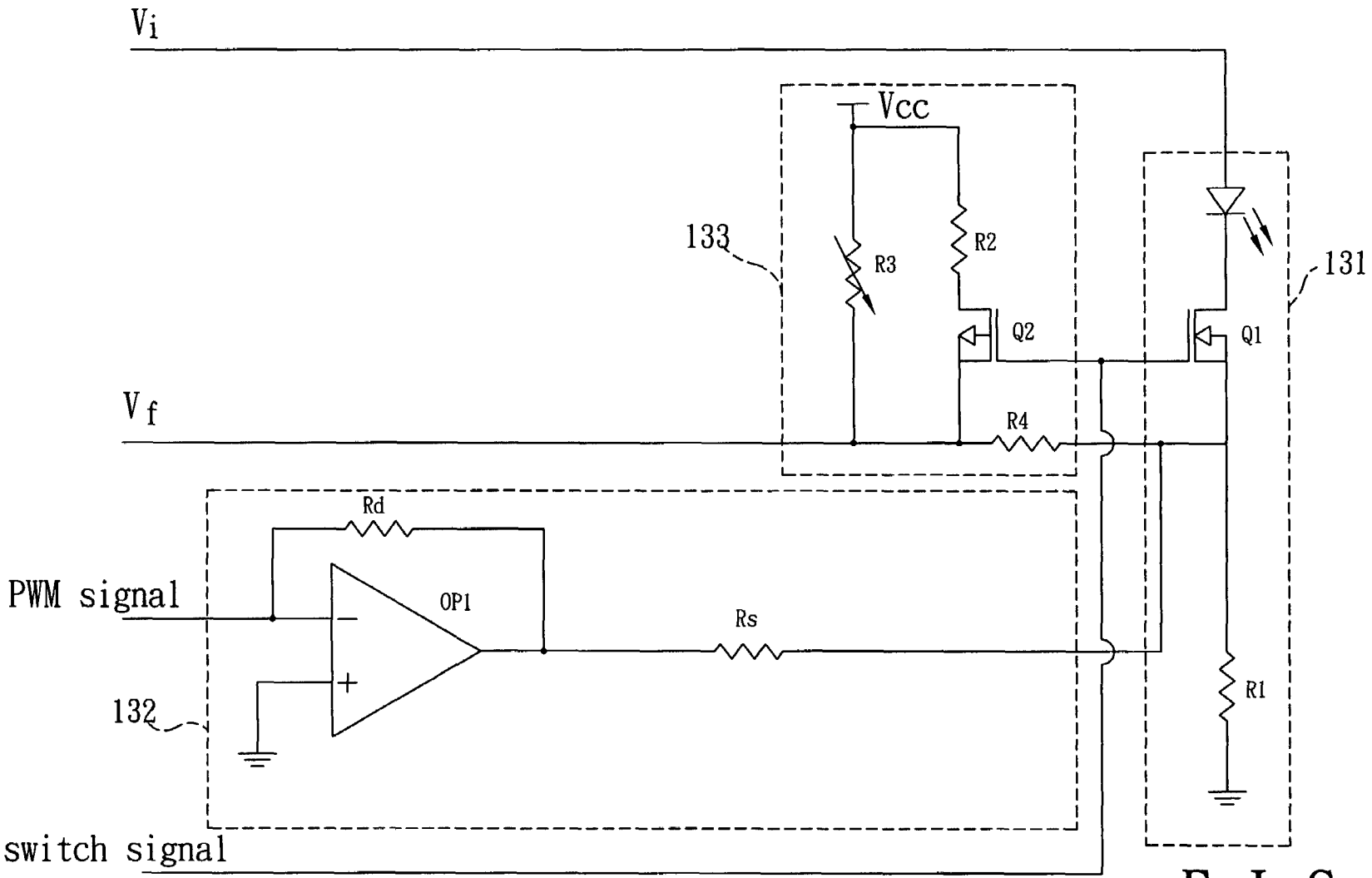
FIG. 4 is a detailed circuit diagram of the driving unit of FIG. 3.

FIG. 4 is a detailed circuit diagram of the driving unit 13 of FIG. 3. In FIG. 4, the LED unit 131 comprises: a LED for receiving the driving signal, a N-channel metal oxide semiconductor (NMOS) Q1 coupled to the LED and used as a switch, and a resistor R1 with one end coupled to ground and the other to the drain of Q1. The first adjusting unit 132 comprises: an operational amplifier OP1 with a non-inverting input, an inverting input and an output, wherein the inverting input receives the PWM signal and the non-inverting input is coupled to ground; a resistor Rd coupled between the non-inverting input and the output; and a resistor Rs coupled between the output and the LED unit 131. The adjusting unit 133 comprises: a power source Vcc, a resistor R2 coupled to Vcc, a PMOS Q2 used as a switch, a variable resistor R3 coupled to Vcc and the source of Q2, and a resistor R4 coupled between the sources of Q1 and Q2.

As shown in FIG. 4, the switch signal is applied to the gates of Q1 and Q2 such that Q1 and Q2 are not connected simultaneously. When Q1 is connected, Q2 is disconnected. At this time, a current is generated by the driving voltage $V_i$ (i.e. the driving signal) to flow through the LED, and the LED is in the light-on state. The first adjusting unit 132 uses OP1 to convert the PWM signal provided by the control unit 12 into a corresponding current and sends it to the LED unit 131, thereby generating a fine-tuning effect on the current flowing through the LED. In addition, the second adjusting unit 133 feedbacks a voltage value $V_f$ (i.e. the feedback signal) to the control unit 12 so as to generate the corresponding driving voltage $V_i$. Compared to the first adjusting unit 132, the second adjusting unit 133 performs a rough tuning on the LED current. On the other hand, when Q2 is connected, Q1 is disconnected. At this time, the connected Q2 provides a discharge path to accelerate the discharge of the LED, thereby achieving the effect of rapid switch mentioned above.

Figure 5:
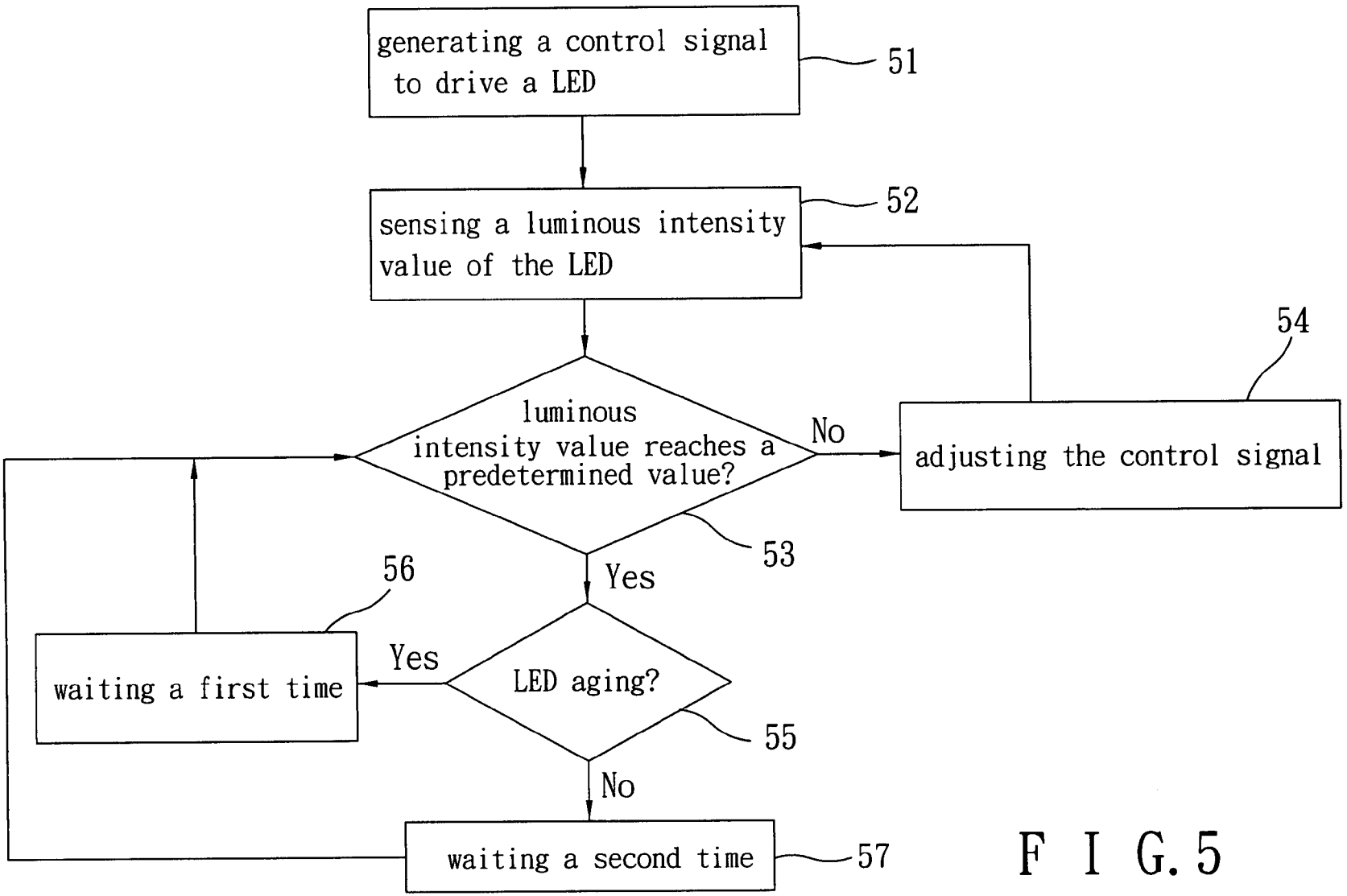
FIG. 5 is a flow chart of a preferred embodiment of the LED control method according to the present invention.

FIG. 5 is a flow chart of a preferred embodiment of the LED control method according to the present invention. As shown in FIG. 5, the flow comprises the steps of:

51 generating a control signal to drive a LED;

52 sensing a luminous intensity value of the LED;

53 determining whether the luminous intensity value reaches a predetermined value, if yes then jumping to step 55, otherwise proceeding to step 53;

54 adjusting the control signal and jumping to step 52;

55 determining whether the LED is aging, if no then jumping to step 57, otherwise proceeding to step 56;

56 waiting a first time and jumping to step 52; and

57 waiting a second time and jumping to step 52.

If the step 53 determines that the luminous intensity value does not reach the predetermined value, the steps 52 to 54 are executed repeatedly until the intensity value reaches the predetermined value. In one embodiment, the color of the LED is one of red, green and blue, and in the step 53, the predetermined value is generated according to the CIE colorimetry.

Besides, if the luminous intensity value reaches the predetermined value, then the step 55 is executed to determine whether the LED is aging. This determination is performed by comparing the control signal and the subsequent luminous intensity value. If the LED is aging, a shorter first time is waited (step 56) and then the step 52 is executed again to perform detection. If the LED is not aging, a longer second time is waited before the step 52 is executed again (step 57).

While the present invention has been shown and described with reference to the preferred embodiments thereof and in terms of the illustrative drawings, it should not be considered as limited thereby. Various possible modifications and alterations could be conceived of by one skilled in the art to the form and the content of any particular embodiment, without departing from the scope and the spirit of the present invention.

What is claimed is:

1. A light-emitting diode (LED) controller comprising:

a sensing unit for sensing a luminous intensity of an LED and outputting a corresponding sensing signal;

a control unit, coupled to the sensing unit, for outputting a control signal according to an outputted value of the sensing signal, wherein the control signal is corresponding to an ideal value of the sensing signal; and a driving unit, coupled to the control unit, for driving the LED according to the control signal, wherein the control unit determines whether the LED is aging by comparing the ideal value with a subsequent outputted value of the sensing signal.

2. The LED controller of claim 1, wherein the control unit determines whether the luminous intensity reaches a predetermined value according to the sensing signal.

3. The LED controller of claim 2, wherein a color of the LED is one of red, green and blue, and the predetermined value is generated according to a CIE colorimetry.

4. The LED controller of claim 2, wherein the control unit comprises:

an analog-to-digital converter (ADC) for converting the sensing signal into a digital response value of the luminous intensity; and a micro processor, coupled to the ADC, for determining whether the luminous intensity reaches the predetermined value according to the response value.

5. The LED controller of claim 1, wherein the control signal comprises a pulse width modulation (PWM) signal, and the driving unit adjusts the luminous intensity according to the PWM signal.

6. The LED controller of claim 1, wherein the control signal comprises a driving signal for driving the LED.

7. The LED controller of claim 6, wherein the driving unit generates a feedback signal, and the control unit outputs the driving signal according to the feedback signal.

8. The LED controller of claim 6, wherein the driving unit comprises:

an LED unit comprising the LED, wherein the LED emits the luminous intensity according to the driving signal; and a first adjusting unit for generating an adjusting signal to the LED unit according to a pulse width modulation (PWM) signal included in the control signal, and adjusting the luminous intensity according to the adjusting signal.

9. The LED controller of claim 8, wherein the first adjusting unit comprises:

an operational amplifier with a non-inverting input, an inverting input and an output, wherein the inverting input receives the PWM signal and the non-inverting input is coupled to ground;

a first resistor coupled between the inverting input and the output; and a second resistor coupled to the output and the LED unit.

10. The LED controller of claim 8, wherein the LED unit comprises:

a first switch coupled to the LED and switching according to a switch signal.

11. The LED controller of claim 10, further comprising:

a second adjusting unit for outputting a feedback signal used to determine the driving signal.

12. The LED controller of claim 11, wherein the second adjusting unit comprises:

a power source;

a variable resistor coupled to the power source and providing the feedback signal; and a second switch coupled to the power source and switching according to the switch signal, wherein the first and second switches are not connected simultaneously.

13. The LED controller of claim 1, wherein the control unit comprises:

a memory for storing a correspondence between the control signal and the ideal value of the sensing signal.

14. The LED controller of claim 1, wherein the control unit determines the LED to be aging if the subsequent outputted value of the sensing signal is lower than the ideal value over a default degree.

15. The LED controller of claim 1, wherein if the LED is aging, the control unit controls the sensing unit to sense the luminous intensity again after a first time; if the LED is not aging, the control unit controls the sensing unit to sense the luminous intensity again after a second time; wherein the first time is shorter than the second time.

16. A light-emitting diode (LED) control method comprising:

generating a control signal to drive an LED;

sensing a luminous intensity value of the LED; and selectively adjusting the control signal according to the luminous intensity value;

wherein the adjusting step comprises:

determining whether the luminous intensity value reaches a predetermined value;

determining whether the LED is aging when the luminous intensity value reaches the predetermined value;

repeatedly executing the sensing step and the adjusting step after a first time if the LED is aging; and repeatedly executing the sensing step and the adjusting step after a second time if the LED is not aging;

wherein the first time is shorter than the second time.

17. The LED control method of claim 16, wherein a color of the LED is one of red, green and blue, and the predetermined value is determined according to a CIE colorimetry.

18. The LED control method of claim 16, further comprising:

repeatedly executing the sensing step and the adjusting step until the luminous intensity value reaches the predetermined value.

19. The LED control method of claim 16, wherein the aging-determining step comprises comparing the control signal and the luminous intensity value.

* * * * *